United States Patent [19]

Baldwin et al.

[11] Patent Number: 4,980,809

[45] Date of Patent: Dec. 25, 1990

[54] LUMINAIRE WITH AUTOMATIC VOLTAGE DISCONNECT

[75] Inventors: Samuel L. Baldwin, E. Flat Rock; Mitchell M. Osteen, Zirconia, both of N.C.

[73] Assignee: General Electric Company, Schenectady, N.Y.

[21] Appl. No.: 469,118

[22] Filed: Jan. 24, 1990

[51] Int. Cl.[5] ..... F21V 17/00

[52] U.S. Cl. ..... 362/375; 362/802

[58] Field of Search ..... 362/21, 362, 374, 375, 362/295, 802

[56] References Cited

U.S. PATENT DOCUMENTS

| | | | |
|---|---|---|---|
| 3,671,739 | 6/1972 | McCain | 362/375 |
| 3,705,302 | 12/1972 | Judge et al. | 240/78 |
| 4,456,857 | 6/1984 | Orr et al. | 315/360 |

*Primary Examiner*—Stephen F. Husar

*Attorney, Agent, or Firm*—John P. McMahon; Stanley C. Corwin; Fred Jacob

[57] ABSTRACT

This luminaire comprises a reflector for receiving a lamp, an opening in the reflector through which light from the lamp is reflected, and a closure removably secured over the opening. Within the luminaire is an energizing circuit for the lamp, and connected within this circuit is a pair of disconnect contacts that are separable to preclude energization of the lamp via the energizing circuit. Actuating means for the disconnect contacts is operable to effect separation of the contacts in response to removal of the closure from its normal position covering the opening. This actuating means includes a plunger of electrical insulating material disposed between the light-transmitting material of the closure and one of said disconnect contacts.

11 Claims, 5 Drawing Sheets

Fig. 1
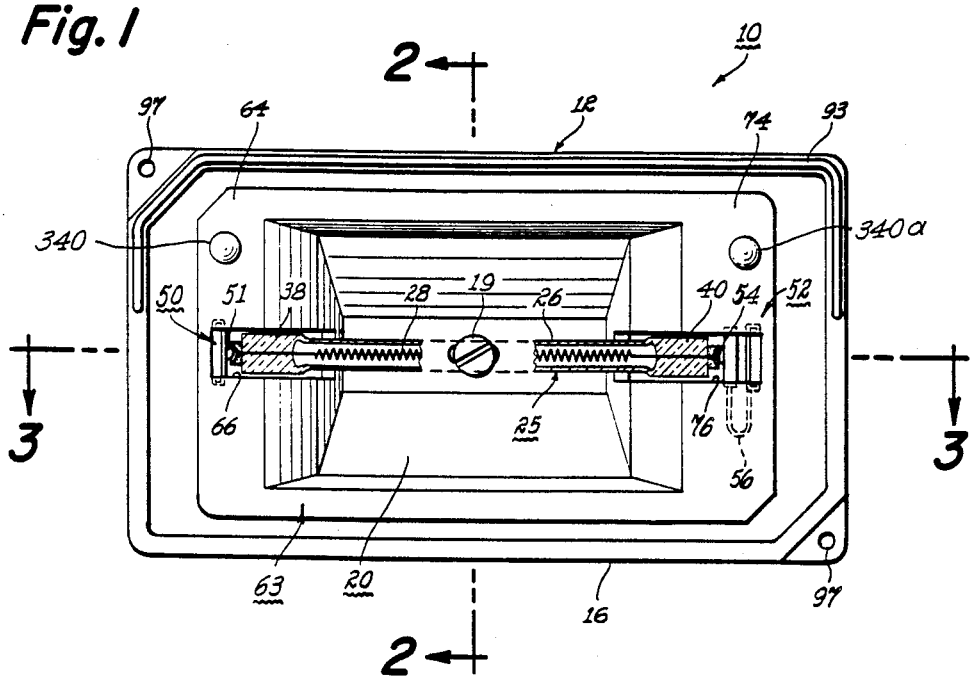
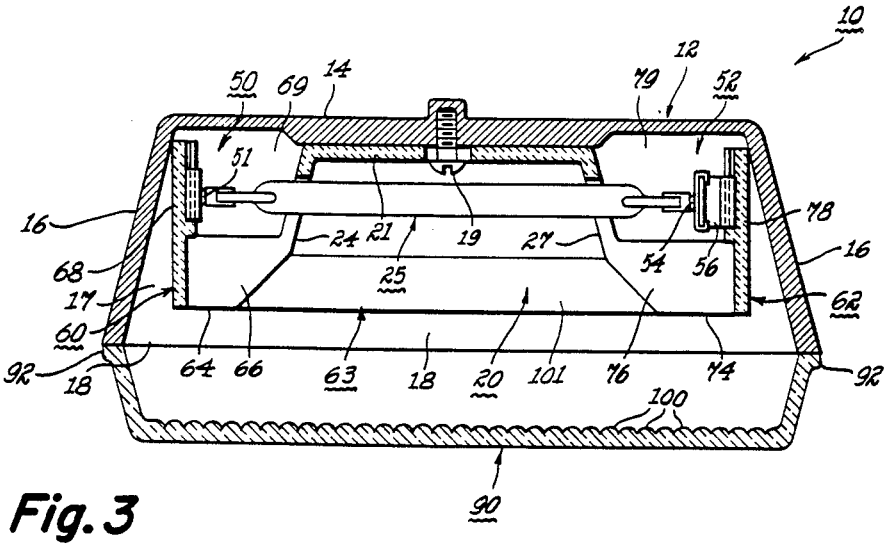
Fig. 3

Fig. 2
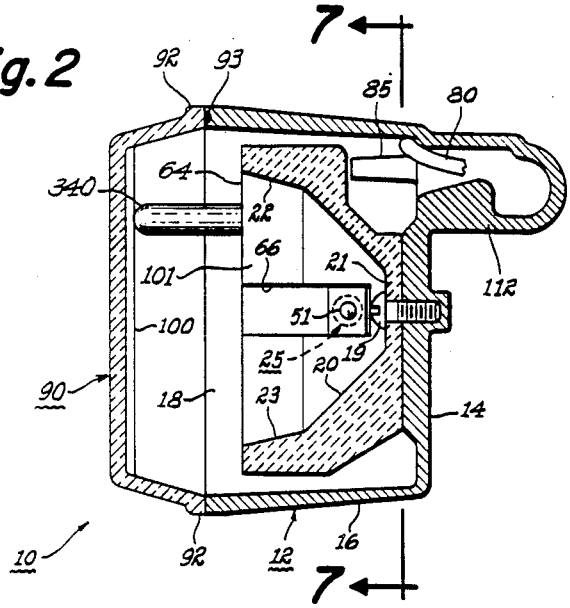
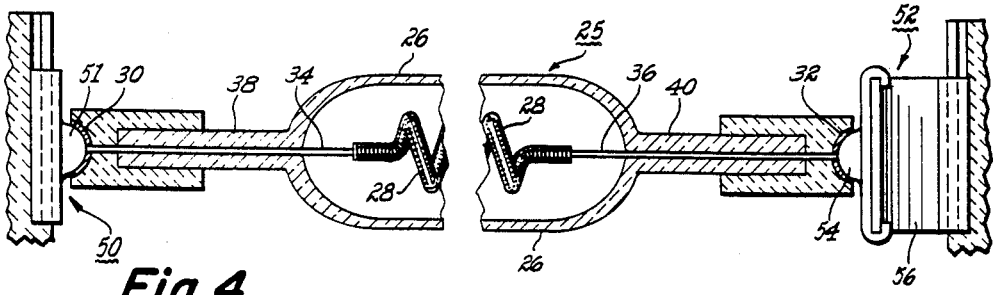
Fig. 4
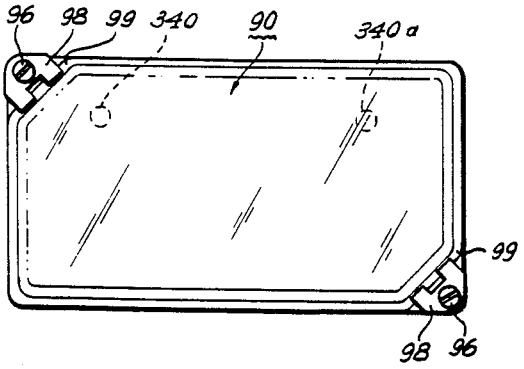
Fig. 5
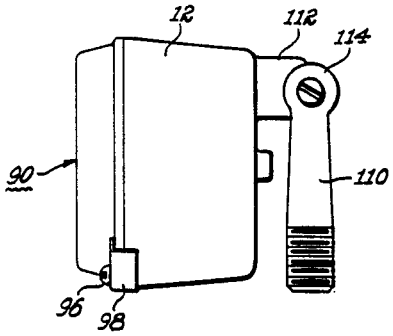
Fig. 6

Fig. 7
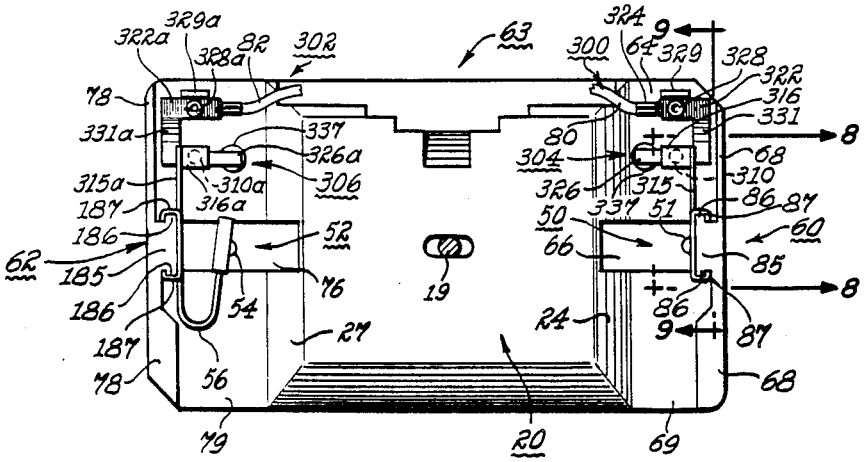
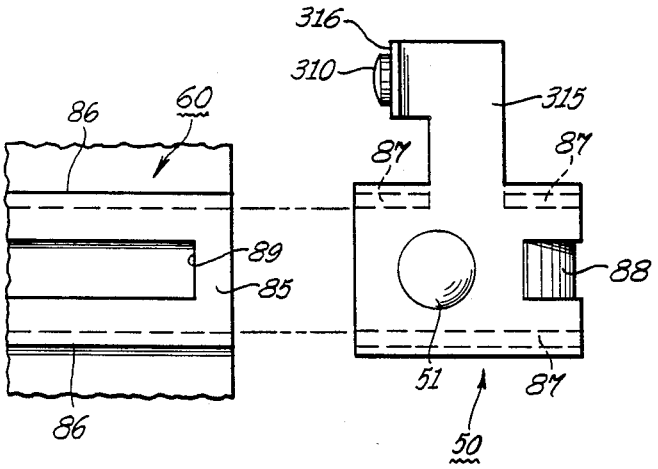
Fig. 8

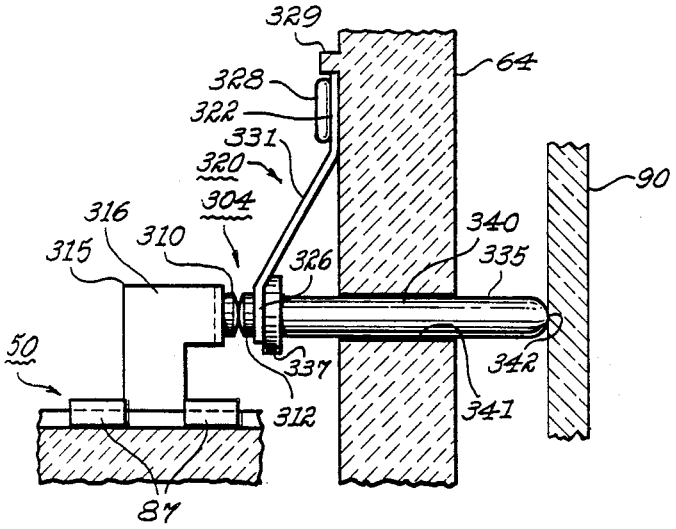
Fig. 9
Fig.10
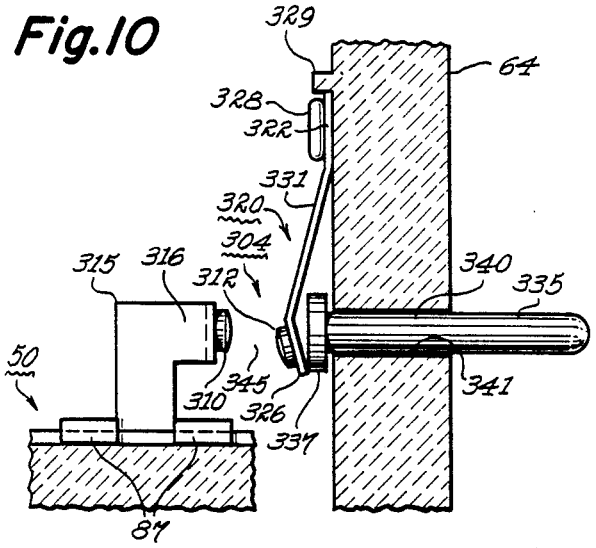

LUMINAIRE WITH AUTOMATIC VOLTAGE DISCONNECT

CROSS-REFERENCE TO RELATED APPLICATION

This application is related to copending application Ser. No. 361,186-Osteen, Murray, and Glanton, filed on Jun. 5, 1989 now U.S. Pat. No. 4,939,629; and such application is incorporated by reference in the present application.

BACKGROUND

This invention relates to a luminaire that includes (i) an opening through which light from a source is reflected and (ii) a closure normally covering said opening, and relates, more particularly, to a luminaire of this type that includes an automatic voltage disconnect that automatically removes any then-present voltage from the light source when the closure is removed from the opening.

To replace a burned-out light source, or lamp, in the above type of luminaire, the usual procedure is to remove the closure from its normal position covering the opening, then to remove the burned-out lamp from its socket or sockets, and then to insert a new lamp into the socket or sockets, following which the closure is returned to its normal position. In some applications, the person who performs this relamping operation will typically insert one or both hands through the luminaire opening and then grip the lamp and perform certain manipulations in order to extract the burned-out lamp. He will perform similar operations, but in a different sequence, in order to introduce a new lamp. Unless some minimal degree of care is exercised in performing these operations, there is a possibility of electrical shock through contact with live circuit components or of buring the hand gripping the lamp when the lamp turns on upon being inserted into a live circuit. Of course, this possibility can be minimized by heeding the usual caution notice calling for disconnection of the luminaire before servicing, but this caution notice may sometimes be overlooked or ignored.

OBJECTS

An object of this invention is to reduce the possibility of electrical shock or of having one's hands burned during a relamping operation.

Another object is to provide an automatic disconnect which acts to automatically disconnect the lamp from its energizing circuit (or ciruits) when the light-transmitting closure of the luminaire is removed as part of a relamping operation.

Still another object is to provide an automatic disconnect capable of attaining the immediately preceding objects and also capable of automatically effecting disconnection of the lamp in response to breakage of the light-transmitting closure.

SUMMARY

In carrying out the invention in one form, we provide a luminaire comprising a reflector for receiving a lamp and having an opening through which the reflector is adapted to reflect light received from the lamp. Removably fixed to this reflector in a position to cover said opening is a closure of light-transmitting material that is removable to afford access to the lamp so as to permit relamping. Within the luminaire is an electric circuit through which the lamp is energizable. Connected within said circuit is a pair of disconnect contacts that are separable to preclude energization of said lamp via said circuit. Actuating means for the disconnect contacts is operable: (i) to effect engagement of the disconnect contacts in response to mounting of said closure in a position to cover said opening and (ii) to effect separation of the disconnect contacts in response to removal of the closure from said opening. This actuating means comprises a plunger having electrical insulating properties disposed between the light-transmitting material of the closure and one of said disconnect contacts when the closure is in place over said opening.

BRIEF DESCRIPTION OF FIGURES

For a better understanding of the invention, reference may be had to the following detailed description taken in conjunction with the accompanying drawings, wherein:

FIG. 1 is a front elevational view of a luminaire embodying one form of the invention but shown without its lens and with its lamp shown partially broken away and in section.

FIG. 2 is a sectional view taken along the line 2—2 of FIG. 1, but with the lamp of FIG. 1 shown in phantom as a dotted-line circle.

FIG. 3 is a sectional view along the line 3—3 of FIG. 1, but showing the lamp is full.

FIG. 4 is an enlarged partially schematic sectional view, taken in the plane of FIG. 3, of the double-ended lamp used in the luminaire of FIGS. 1–3. Also shown in the figure are the contacts that engage the lamp terminals.

FIG. 5 is a front elevational view on a reduced scale of the luminaire of FIG. 1 and showing the lens of the luminaire clamped in place.

FIG. 6 is a side elevational view of the luminaire depicted in FIG. 5.

FIG. 7 is an enlarged rear view of the reflector and socket structure of the illustrated luminaire, as viewed along the line 7—7 of FIG. 2, but without the lamp. Also shown in FIG. 7 are two voltage disconnect switches mounted on the back side of the reflector.

FIG. 8 is a slightly enlarged detailed view of certain of the parts depicted in FIG. 7, i.e., contact structure and associated ceramic supporting structure, as viewed from the line 8—8 of FIG. 7, but showing these parts just prior to assembly.

FIG. 9 is an end view of one of the voltage disconnect switches taken along the line 9—9 of FIG. 7.

FIG. 10 is an end view similar to FIG. 9 except showing the switch of FIG. 9 in its contact-disengaged, or open, position.

DETAILED DESCRIPTION OF EMBODIMENTS

Figure 11:
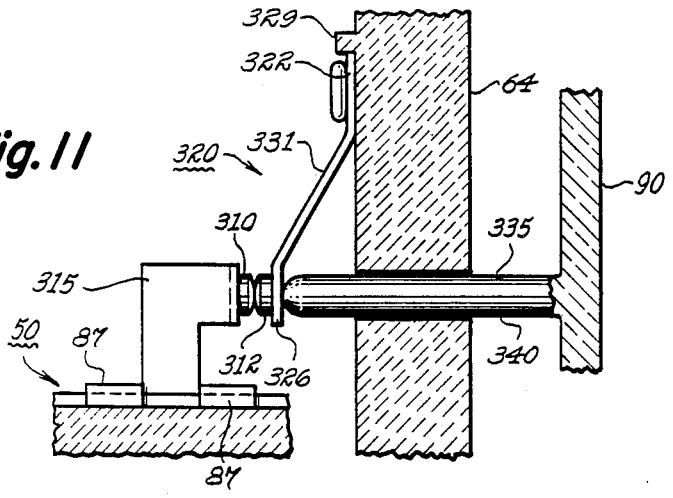
FIG. 11 is a view similar to that of FIG. 9 except depicting a modified form of invention.

Except for an automatic disconnect (soon to be described), the luminaire depicted in FIGS. 1–8 is substantially the same as the luminaire of the aforesaid application Ser. No. 361,186, now U.S. Pat. No. 4,939,629, Osteen et al. The same reference numerals are used in these two applications to designate corresponding parts. Reference may be had to the earlier application for a more detailed description of parts common to both applications and their functions.

Referring now to FIGS. 1–3, there is shown a luminaire 10 comprising a cup-shaped metal housing 12 having a back wall 14 and a hollow, generally rectangular body 16 projecting from the back wall toward the front of the luminaire. The hollow body 16 surrounds an internal space 17 within the luminaire and has one end open to define a mouth 18.

Within the housing 12, there is located a reflector 20 of ceramic material that is generally concave with respect to the front of the luminaire. This reflector 20 is suitably fixed within the housing 12, for example, by a screw 19 extending through a central opening in the reflector and threaded into an aligned hole in the housing. As best seen in FIG. 2, the reflector includes a base 21 at its back side and portions 22 and 23 at its top and bottom projecting forwardly from the base. In addition, as best shown in FIG. 3, the reflector includes end portions 24 and 27 at its lateral edges projecting from base 21 in a flared, or divergent, relationship with respect to each other.

Also within the housing 12 is a double-ended lamp 25, a preferred form of which is a conventional halogen-cycle quartz lamp. Referring to FIG. 4, this lamp comprises a transparent quartz tube 26 within which is located a tungsten filament 28 of helical form extending axially of the tube and connected between a pair of conductive terminals 30 and 32 located at opposite ends of the tube. Lead-in wires 34, 36 at opposite ends of the tungsten filament pass through suitable seals 38, 40 that support the filament within tube 26 and seal the interior of the lamp from the surrounding space. Each lead-in wire 34 or 36 is connected at one end to an associated terminal 30 or 32 and at its opposite end to one end of the filament 28.

The tubular lamp 25 extends across the reflector, as seen in FIG. 3, and is partially surrounded by the reflector, as seen in FIG. 2. At opposite ends of the lamp 25, there are contact structures 50 and 52 for respectively engaging the lamp terminals and thus connecting them into an external circuit. Referring to FIGS. 3 and 4, the left-hand contact structure 50 comprises a hemispherically-shaped stationary contact 51 that fits within a mating recess in one of the lamp terminals 30. The other contact structure 52 comprises a movable hemispherically-shaped contact 54 that is spring-biased by a leaf spring 56 into engagement with a mating recess in the other lamp terminal 32.

Each of the contact structures 50 and 52 constitutes a portion of a socket for receiving one terminal of the lamp. Referring especially to FIG. 3, each socket further comprises a ceramic support for supporting the contact structure and for electrically insulating the contact structure from the metal housing 12. The left-hand ceramic support, as seen in FIG. 3, is designated 60 and the right-hand one is designated 62. In the illustrated embodiment, these two ceramic supports 60 and 62 are integral with the ceramic reflector 20 so that the reflector and the ceramic supports taken together constitute a single integral ceramic piece 63.

In FIG. 3, the left-hand ceramic support 60 comprises a ceramic wall, or face, 64 in front of the associated contact structure 50; and this face 64 has a slot 66 extending therethrough through which the left-hand end of the lamp 25 is passed when the lamp is being inserted into the luminaire from the front side of the luminaire. Slot 66 also extends into the end portion 24 of the reflector 20 so as to accommodate the left-hand end of the lamp 25 when the lamp is fully inserted. Referring still to FIG. 3, ceramic support 60 also comprises a flange 68 at the left-hand outer edge of the ceramic piece 63 that extends backwardly from the ceramic face 64 to form with the adjacent ceramic structure a recess 69 in which the contact structure 50 is located.

In FIG. 3, the right-hand ceramic support 62 is of generally the same configuration as the left-hand support 60. More specifically, the right-hand ceramic support 62 comprises a ceramic face 74 that has a slot 76 extending therethrough through which the right-hand end of the lamp 25 is passed when the lamp is being inserted into the luminaire from the front side of the luminaire. Slot 76 extends into the end portion 27 of the reflector 20 so as to accommodate the right-hand end of lamp 25 when the lamp is fully inserted. Ceramic support 62 further comprises a flange 78 at the right-hand outer edge of ceramic piece 63 that extends backwardly from ceramic face 74 to form with the adjacent ceramic structure a recess 79 in which the contact structure 52 is located. This recess is made somewhat larger than recess 69 to provide space for the leaf spring 56 that is used for biasing movable contact 54 into engagement with lamp terminal 32.

Referring to FIGS. 7 and 8, for supporting the contact structure 50 on the ceramic support 60, the support 60 is provided on its back side with an integral ceramic boss 85 having horizontally-extending upper and lower projections 86 at its free end. Contact structure 50 has fingers 87 that are adapted to partially embrace these projections 86. Referring to FIG. 8, the contact structure 50 can simply be slid onto boss 85 from the back side of the ceramic support 60, guided by the cooperating components 86 and 87. When the contact structure has thus been slid into the proper position against a stop, an inwardly projecting detent 88 on the contact structure snaps into place behind a shoulder 89 on the ceramic support, locking the contact structure in the desired position.

As also shown in FIG. 7, the other contact structure 52 is similarly supported on a ceramic boss (185) integral with and at the back side of the associated ceramic support 62. This boss 185 is shaped the same as the above-described boss 85, having horizontally-extending upper and lower projections 186 at its free end. The leaf spring 56 of contact structure 52 has fingers 187 that are adapted to partially embrace these projections 186. The leaf spring 56, having contact 54 suitably attached thereto, can simply be slid over the boss 185 from the back side of the ceramic support 62, guided by cooperating components 186 and 187. When the leaf spring has thus been slid into the proper position, it is locked in place by a detent on the spring snapping behind a shoulder on the ceramic. The detent and shoulder are the same as shown in FIG. 8, and the parts are slid together and locked in the same manner as described in the immediately-preceding paragraph.

It will be apparent from the two immediately preceding paragraphs that each of the contact structures can be readily and quickly mounted and locked on its supporting ceramic by simply sliding the contact structure into its desired position and without requiring any separate fastening devices, especially separate fastening devices requiring insertion or manipulation.

Referring to FIG. 7, contact structures 50 and 52 are connected in an external circuit by two energizing circuits 300 and 302, respectively. One of the energizing circuits 300 includes an insulated wire 80 and a disconnect switch 304 connected electrically in series with each other and with contact structure 50. The other energizing circuit 302 includes an insulated wire 82 and a disconnect switch 306 connected electrically in series with each other and with contact structure 52. The disconnect switches 304 and 306, which are essentially identical, will soon be described in more detail.

Each of the wires 80 and 82 is connected at one end to its associated disconnect switch by a suitable crimp connector. Each of these wires extends along the inner surface of the back wall 14 of metal housing 12 and exits the housing through a centrally located hole in this back wall. As seen in FIG. 2, the back wall includes integral shelf members 85 that project forwardly near the top of the housing body 16 thereby forming grooves in the housing for receiving the insulated wires. The insulated wires fit tightly in these grooves, thereby assuring that the wires will be held out of contact with the ceramic reflector 20, thus protecting them from the high temperatures of the ceramic reflector. The metal housing 12, being exposed to the surrounding ambient and being a good heat conductor, operates at much lower temperatures than the ceramic reflector.

As shown in FIG. 2, the luminaire includes at its front side a lens, or closure, 90 that is outwardly dished with respect to the interior space of the luminaire. This lens 90 includes a peripheral flange portion 92 that is aligned at its rear end with the front end of the hollow body 16 of the metal housing 12. A suitable gasket 93 is disposed between the aligned end surfaces of parts 16 and 92 and serves when these parts are clamped together to provide a leak-proof joint between them.

The lens, or closure, 90 is clamped to the metal housing 12 by suitable fastening means, best shown in FIG. 5.

This fastening means comprises screws 96 threaded into holes 97 (FIG. 1) in two corners of the metal housing 12. Beneath the head of each screw is a clip 98 that fits over a corner flange portion 99 on the lens so that when the screws are tightened, the lens is clamped against the housing.

The lens 90 is preferably made of molded borosilicate glass. On the inner surface of the lens are refractors in the form of the flutes 100 of FIGS. 2 and 3, which serve to facilitate improved control of the light output from the luminaire.

When the lamp 25 is energized, most of the light emitted by its incandescent filament 28 is projected onto the ceramic reflector 20, and the reflector reflects this light in a direction generally forwardly of the luminaire. The reflected light passes through the open end 101 of the reflector and through the lens 90. The refractors 100 on the lens act to distribute this light in the desired pattern. The reflector 20, though made of ceramic rather than the usual metal, has a high degree of reflectance and is capable of reflecting about 90 percent of the incident light, most of it in a diffuse state.

The lamp 25 is installed after the reflector and sockets are mounted in the casing 12, as described in the aforesaid patent application Ser. No. 361,186, now U.S Pat. No. 4,939,629. This is done simply by inserting the lamp horizontally as depicted in FIGS. 1 and 2, causing its ends to enter the slots 66 and 76 and to seat on the contacts 51 and 54 of the sockets.

For blocking access to the contact structures 50 and 52 except through the slots 66 and 76, the faces 64 and 74 of the ceramic piece 63 are extended vertically, as seen in FIG. 1, for substantial distances on opposite sides of the slots 66 and 76. This reduces the possibility of unintentional exposure to these contact structures. In addition, the vertically-extending faces 64 and 74 serve to give the luminaire a neat, finished look and also provide reflecting surfaces on their front to again reflect any light that might be reflected from the lens 90.

FIG. 6 illustrates a suitable supporting arrangement for the luminaire of FIGS. 1–5. This supporting arrangement comprises a stem 110 connected to a projecting lug 112 on the rear side of housing 12 by means of a suitable swivel joint 114. These parts are preferably made hollow so that they can serve as a conduit for carrying wires 81 and 82 to the interior space 17 within the housing 12.

RELAMPING

Luminaires typically include a caution notice that cautions that the luminaire must be disconnected before it is opened for servicing, but there is a possibility that this caution notice will be overlooked or ignored. The present invention is intended to serve as a back-up in the event that the caution notice is ignored or overlooked.

In order to relamp the hereinabove described luminaire, the lens 90 of FIGS. 2, 3, 5, and 6 is first removed from its normal position covering the opening 101 of the reflector by a maintenance person. Then the maintenance person will typically insert his hand through the opening 101 in the reflector and grasp the lamp 25, and thereafter he will push the lamp to the right as viewed in FIGS. 1 and 3 to disengage the left hand lamp terminal from lamp contact 51, following which he will pull the lamp forwardly out of engagement with contact 54. During such forward movement, the ends of the lamp pass along the slots 66 and 67, and when the ends have cleared the slots, the lamp is completely withdrawn from the luminaire through the opening 101 in the reflector. Replacement of the lamp is effected by inserting a new lamp horizontally through reflector opening 101, passing its terminals 30 and 32 through the slots 66 and 76, and finally seating the terminals on the contacts 51 and 54.

THE DISCONNECT SWITCHES 304 AND 306

Referring to FIG. 7, the disconnect switch 304 serves to automatically disconnect the lamp contact structures 50 and 52 from the energizing circuit 300 should the lens 90 of the luminaire be removed to permit relamping or for any other reason. Similarly, the other disconnect switch 306 serves to automatically disconnect the lamp contact structures 50 and 52 from the energizing circuit 302 should the lens 90 of the luminaire be removed.

Referring to FIGS. 9 and 10, the disconnect switch 304 comprises a pair of separable disconnect contacts 310 and 312. One of these disconnect contacts 310 is a stationary contact that is mounted directly on the lamp contact structure 50. The other of the disconnect contacts 312 is a movable contact which can be actuated into and out of engagement with the stationary disconnect contact 310.

For mounting the stationary disconnect contact 310 on the lamp contact structure 50, the lamp contact structure is provided with an upwardly-projecting extension 315 that includes a horizontally-projecting tab 316 at its upper end that carries disconnect contact 310.

For mounting the movable disconnect contact 312, a leaf spring 320 that has a U-shaped configuration as viewed in FIG. 7 is provided. This U-shaped leaf spring comprises a horizontally-extending upper arm 322, a horizontally-extending lower arm 326 vertically spaced from the upper arm, and a generally vertically-extending bight portion 331 that interconnects the two arms. The upper arm 322 is fixed to the back side of the ceramic wall 64 of the reflector, and has a crimp joint 324 at its left hand end for connecting wire 80 to the U-shaped leaf spring 320. The horizontally-extending lower arm 326 carries the movable disconnect contact 312. In one form of the invention, the leaf spring 320 is made of beryllium copper, a material that (1) has good electrical conducting properties to enable the leaf spring to effectively conduct current between crimp joint 324 and the disconnect contact 312 and (2) has sufficient resilience and fatigue resistance to reliably actuate the movable disconnect contact 312 in the manner soon to be described despite prolonged exposure to the high temperatures developed in the nearby ceramic by the luminaire. The upper arm 322 is disposed in engagement with the ceramic wall 64 and is suitably fixed to the ceramic wall, as by a rivet 328 and a projection 329 on the ceramic wall 64 engaging the edge of the upper arm to prevent rotation of the leaf spring 320 about the rivet. The lower arm 326 is horizontally spaced from the ceramic wall and is movable with respect to the ceramic wall. The lower arm is supported from the upper arm by the resilient bight portion 331, which when unstressed (as shown in FIG. 10), positions the lower arm near the ceramic wall and away from the stationary disconnect contact 310, thereby holding the movable disconnect contact 312 in a disengaged, or open, position. The bight portion 331 is unstressed when the lens 90 is removed from its normal position in front of the reflector opening 101, and thus the disconnect contacts 310, 312 are disengaged when the lens is so removed. The disconnect contacts are caused to engage in response to movement of the lens into its normal position covering the reflector opening 101, as will now be explained.

For producing disconnect-contact-engagement in response to movement of the lens 90 into its normal position covering the reflector opening 101, a plunger 335 of electrical insulating material is disposed between a portion of the lens 90 and the lower arm 326 of the disconnect switch. This plunger has (i) an enlarged head 337 at one end for contacting the outer end of the lower arm and (ii) a shaft 340 that extends with slight clearance through a guide hole 341 in the ceramic wall 64. The opposite end 342 of the plunger engages the lens 90 when the lens is in its closed position of FIG. 9. When the lens is unclamped and withdrawn from the metal housing 12, the leaf spring 320 responds by moving its bight portion 331 and its lower arm 326 into their unstressed positions of FIG. 10, thereby driving the movable disconnect contact 312 out of engagement with the stationary disconnect contact 310, thus establishing an isolating gap 345 between the contacts. In moving into its unstressed condition shown in FIG. 10, the leaf spring 320 also moves the plunger 335 to the right into its position of FIG. 10. Since the other disconnect switch 306 is substantially identical to the above-described disconnect switch 304, a detailed description of switch 306 is considered to be unnecessary. In FIG. 7, parts of switch 306 that correspond to similar parts in switch 304 are designated with the same reference numerals as in the switch 304 except with the suffix "a" added to the parts in switch 306.

Since the disconnect switches 304 and 306 are automatically opened when the lens, or closure, 90 is removed from its position over the opening 101 in the reflector 20, it will be apparent that the energizing circuits 300 and 302 are disconnected from the lamp contact structures 50 and 52 during this period. The lamp contact structure are, in effect, dead during this period; and, thus, the risk of electric shock through accidental contact with either of them during relamping is materially reduced.

If one introduces a new lamp into an energized circuit while grasping the lamp in his bare hand, causing the lamp to turn on as soon as its terminals engage its contacts, there is a possibility that the lamp will heat up sufficiently to burn his hand before he releases the lamp. The possibility of such an occurrence is materially reduced in our luminaire because the disconnect switches 304 and 306, which are open during this interval, maintain the lamp contacts deenergized and preclude immediate lamp turn-on. It is only when the lens, or closure, 90 is later restored to its normal position over the opening 101 in the reflector that the disconnect switches are closed and turn-on of the lamp is permitted.

It is to be noted that the disconnect switches 304 and 306 are located behind the ceramic reflector 20 and thus access to them during relamping is highly restricted. Referring to FIGS. 2 and 7, this is especially so since each of the disconnect switches is located within a restricted-access recess (69 or 79) bounded by ceramic walls (e.g., ceramic walls 64, 68, and 24 in the case of switch 304). Although there are slots (e.g., 66) in certain of the ceramic walls (e.g. in ceramic walls 64 and 24 bounding recess 69), these slots are located well below the location of the disconnect switch within the recess and do not afford ready access to the portions of the switch that are live when the switch is in its open position.

A special feature of our automatic disconnect is that it is also responsive to breakage of the lens, or closure, 90. Should this closure 90 be broken for any reason, the glass portion of the closure engaged by the outer end of the plungers will usually fall from the luminaire and thus no longer restrain the plunger against outward movement. This will allow the leaf spring (320 or **320*a***) within each disconnect switch to open the disconnect switch in the same manner as described above in the case where the closure is purposely removed.

Another embodiment of this invention is illustrated in FIG. 11. In this embodiment, each plunger for controlling the movable contact of a disconnect switch, instead of being separate from the lens 90 as shown in FIGS. 9 and 10, is joined to the lens. In addition, in the FIG. 11 embodiment neither plunger has an enlarged head corresponding to the head 337 of FIGS. 9 and 10. Accordingly, when the lens 90 of FIG. 11 is removed from its normal position covering the opening in the reflector, the plungers are removed with the lens.

The leaf spring in each disconnect switch responds to this plunger-removal by actuating its associated movable disconnect contact 312 or **312*a* into a disengaged, or open, position, thereby establishing the desired isolating gap at each end of the lamp. When the lens 90 is later returned to its normal closed position, the plungers connected thereto engage the lower arms 326 and 326*a*** in the two disconnect switches and thus operate the movable disconnect contacts into their closed position as the lens is moved into its fully seated position.

An advantage of the FIG. 11 embodiment is that by completely removing the plungers when the lens is removed, there is no chance of a plunger being inadvertently operated to close a disconnect switch while the lens is removed.

An advantage of the U-shaped configuration that is used for the leaf spring 320 (or 320*a*) in both embodiments is that its use permits the leaf spring to have the length required to impart the required springiness, but without requiring the spring to extend across the lamp-terminal receiving slot 66, where it would be more exposed and more readily susceptible to accidental contact during relamping. As will be clear from FIG. 7, our U-shaped leaf spring is disposed entirely at one side, the upper side, of the slot 66. With regard to the effective length of our spring, it is noted that both the bight portion 331 and the lower arm 326 contribute to this effective length since only the upper arm 322 is directly attached to fixed structure.

Figure 12:
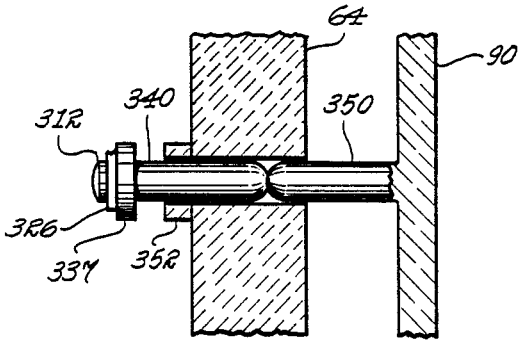
FIG. 12 illustrates another modified embodiment of the invention shown with the lens of the luminaire in its normal position covering the reflector opening.
Figure 13:
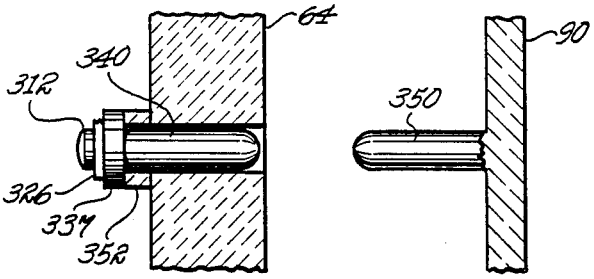
FIG. 13 shows the embodiment of FIG. 12 with the lens in a position removed from the luminaire opening.

Another modified form of the invention is illustrated in FIGS. 12 and 13. In this form, a plunger similar to the plunger of FIG. 9 is used for actuating the movable disconnect contact 312, but this plunger differs from that of FIG. 9 by having a much shorter shaft 340. In fact, the shaft 340 of FIGS. 12 and 13 is so short that it does not project beyond the front face of the ceramic wall 64, even when the lens 90 is removed. This plunger is actuated by a rod 350 secured to the lens 90 in alignment with plunger shaft 340. An advantage of this modification over that of FIG. 11 is that a shorter rod, carried by the lens, can be used for actuating the disconnect switch in response to movement of the lens into its normally closed position.

To prevent the plunger from moving to the right beyond its position of FIG. 13, a tubular ceramic sleeve 352 is provided about its shaft 340 in a location to the left of the wall 64. This sleeve, which may be integral with or attached to the ceramic wall 64, prevents the plunger from projecting in front of the wall when the lens 90 is removed, thus making the plunger less susceptible to unintentional actuation.

While we have shown and described a particular embodiment of our invention, it will be apparent to those skilled in the art that various changes and modifications may be made without departing from our invention in its broader aspects; and we, therefore, intend in the appended claims to cover all such changes and modifications as fall within the true spirit and scope of our invention.

What we claim as new and desire to secure by Letters Patent of the United States is:

1. A luminaire comprising:

(a) a reflector for receiving a lamp and having an opening through which the reflector is adapted to reflect light received from said lamp, (b) a closure of light-transmitting material removably fixed to said reflector in a position to cover said opening, the closure being removable from said opening to afford access to said lamp so as to permit relamping, (c) an electric circuit within said luminaire through which said lamp is energizable, (d) a pair of separable disconnect contacts connected within said electric circuit, the contacts being separable to preclude energization of said lamp via said electric circuit, and (e) actuating means operable to effect engagement of said disconnect contacts in response to mounting of said closure in a position to cover said opening and operable to effect separation of said disconnect contacts in response to removal of said closure from said opening, said actuating means comprising a plunger having electrical insulating properties disposed between the light-transmitting material of said closure and one of said disconnect contacts when the closure is in place over said opening.

2. The luminaire of claim 1 in which said actuating means is normally responsive to breakage of said closure to effect separation of said disconnect contacts.

3. The luminaire of claim 1 in which said actuating means is responsive to breakage of the light-transmitting material of said closure in the location of said plunger to effect separation of said disconnect contacts.

4. The luminaire of claim 1 in which said plunger has an outer end bearing against said light-transmitting material of the closure.

5. The luminaire of claim 1 in which said plunger is connected to said closure so as to be movable therewith when the closure is removed from said opening.

6. The luminaire of claim 1 in which:

(a) the luminaire further comprises means including a wall of electrical insulating material between said disconnect contacts and said opening for restricting access to said contacts when said closure is removed from its position covering said opening, and (b) said insulating wall includes a hole through which said plunger is movable to effect engagement of said disconnect contacts when said closure is being moved into its position to cover said opening.

7. A luminaire as defined in claim 1 and further comprising:

(a) a second electrical circuit within said luminaire through which said lamp is energizable.

(b) a second pair of disconnect contacts connected within said second electrical circuit, said second pair of disconnect contacts being separable to preclude energization of said lamp via said second electrical circuit, and (c) second actuating means operable to effect engagement of said second pair of disconnect contacts in response to mounting of said closure in said position to cover said opening and operable to effect separation of said second pair of disconnect contacts in response to removal of said closure from said opening, said second actuating means comprising a second plunger having electrical insulating properties that is disposed between the light-transmitting material of said closure and one of said disconnect contacts when the closure is in place over said opening.

8. The luminaire of claim 1 in which:

(a) the luminaire further comprises contact structure adapted to engage a lamp terminal when the lamp is mounted within said reflector, (b) one of said disconnect contacts is mounted on said contact structure, (c) said actuating means comprises spring means biasing said other disconnect contact in a direction away from said one disconnect contact, and (d) said plunger is effective to block said spring means from moving said other disconnect contact out of engagement with said one contact while said closure is in place over said opening but is ineffective to block said spring means from effecting said contact-disengaging movement when said closure is removed from said opening.

9. The luminaire of claim 8 in which:

(a) said spring means comprises a U-shaped leaf spring comprising a pair of spaced-apart arms and a bight portion interconnecting said arms at one end of the arms.

(b) means is provided for fixedly connecting one of said arms to stationary structure of said luminaire, the other of said arms being a movable member supported from said one arm by said bight portion, and (c) one of said disconnect contacts is carried by said other arm.

10. The luminaire of claim 9 in which said U-shaped leaf spring is an electro-conductive member connected in series with said disconnect contacts in said energizing circuit.

11. The luminaire of claim 1 in which:

(a) said separable disconnect contacts include one disconnect contact that is movable, (b) there is provided for actuating said plunger a projecting member connected to said closure for movement with said closure when the closure is removed from said opening, and (c) said plunger is disposed between said projecting member and said movable disconnect contact.

* * * * *